US011352964B2

(12) United States Patent
Koenen et al.

(10) Patent No.: US 11,352,964 B2
(45) Date of Patent: Jun. 7, 2022

(54) CYLINDER DEACTIVATION FOR A MULTIPLE CYLINDER ENGINE

(71) Applicant: Briggs & Stratton, LLC, Wauwatosa, WI (US)

(72) Inventors: Robert Koenen, Pewaukee, WI (US); Jason Hansen, Elkhorn, WI (US); Jacob Zuehl, Wauwatosa, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 686 days.

(21) Appl. No.: 16/153,368

(22) Filed: Oct. 5, 2018

(65) Prior Publication Data

US 2019/0107062 A1 Apr. 11, 2019

Related U.S. Application Data

(60) Provisional application No. 62/569,292, filed on Oct. 6, 2017.

(51) Int. Cl.

| | |
|---|---|
| ***F02D 17/02*** | (2006.01) |
| ***F02D 29/06*** | (2006.01) |
| ***F21L 14/00*** | (2006.01) |
| ***F02P 5/15*** | (2006.01) |
| ***F02D 13/06*** | (2006.01) |
| ***F02P 9/00*** | (2006.01) |
| ***F02D 41/00*** | (2006.01) |
| ***F02P 5/04*** | (2006.01) |

(52) U.S. Cl.

CPC ..... *F02D 17/02* (2013.01); *F02D 13/06* (2013.01); *F02D 29/06* (2013.01); *F02D 41/0087* (2013.01); *F02P 5/1502* (2013.01); *F02P 9/002* (2013.01); *F21L 14/00* (2013.01); *F02P 5/045* (2013.01)

(58) Field of Classification Search

CPC ..... F02D 17/02; F02D 41/0087; F02D 13/06; F21L 14/00; F02P 5/1502; F02P 9/002; F02P 5/045; F02P 9/005; Y02T 10/12

USPC ..... 290/40 B; 123/332, 334, 339.18, 339.19; 701/112

See application file for complete search history.

(56) References Cited

U.S. PATENT DOCUMENTS 2,166,968 A * 7/1939 Rohlin ..... F02D 17/00 123/184.32
4,064,844 A * 12/1977 Matsumoto ..... F02D 41/0087 123/481

(Continued)

FOREIGN PATENT DOCUMENTS

GB 2075119 A * 11/1981 ..... F02D 17/02
JP 59105969 A * 6/1984 ..... F02P 9/005

*Primary Examiner* — Sizo B Vilakazi
*Assistant Examiner* — Brian R Kirby
(74) *Attorney, Agent, or Firm* — Foley & Lardner LLP

(57) ABSTRACT

Portable jobsite equipment includes a generator including an internal combustion engine and an alternator. The internal combustion engine includes a first cylinder including a first spark plug configured to create a first electrical spark, a second cylinder including a second spark plug configured to create a second electrical spark, an electronic control unit configured to activate and deactivate at least one of the first cylinder and the second cylinder, and a load source receiving supplied power from the generator. The electronic control unit activates one of the first cylinder and the second cylinder in response to a threshold increase of the load source.

19 Claims, 6 Drawing Sheets

(56) References Cited

U.S. PATENT DOCUMENTS 4,181,929 A * 1/1980 Barber ..... F21S 9/022 362/192
4,305,356 A * 12/1981 Walsh ..... F01L 13/0005 123/198 F
4,391,240 A 7/1983 Sugasawa et al.
4,411,230 A * 10/1983 Lee ..... F02D 41/0087 123/198 F
4,520,272 A * 5/1985 Danno ..... F02D 31/003 290/40 A
4,625,123 A * 11/1986 Gillett ..... H02P 9/105 290/40 B
4,973,896 A * 11/1990 Shiga ..... H02J 7/1438 322/28
5,368,000 A * 11/1994 Koziara ..... F02B 75/06 123/192.2
5,377,631 A * 1/1995 Schechter ..... F01L 9/10 123/198 F
5,563,802 A * 10/1996 Plahn ..... H02J 9/08 700/297
5,669,349 A * 9/1997 Iwata ..... F01N 13/12 123/196 S
5,691,692 A * 11/1997 Herbstritt ..... F02B 63/00 123/198 D
5,826,557 A * 10/1998 Motoyama ..... F02D 17/02 123/198 F
5,826,563 A * 10/1998 Patel ..... F02D 17/02 123/481
5,970,951 A * 10/1999 Ito ..... F02M 35/165 123/198 D
6,186,114 B1 * 2/2001 Nakamura ..... F02B 61/045 123/335
6,408,625 B1 * 6/2002 Woon ..... F02D 41/0007 60/608
6,517,394 B2 * 2/2003 Ozawa ..... F02B 61/045 440/1
6,555,929 B1 * 4/2003 Eaton ..... F02D 11/105 290/24
6,645,017 B1 * 11/2003 Skrzypek ..... B63J 3/02 440/6
6,688,282 B1 * 2/2004 Okubo ..... F02D 31/003 123/334
6,943,531 B2 * 9/2005 Fukaya ..... F02D 29/06 322/10
7,073,488 B2 * 7/2006 Hasler ..... F02D 17/02 123/198 DB
7,289,901 B2 * 10/2007 Kishibata ..... F02D 31/001 307/10.1
7,325,534 B1 * 2/2008 Waters ..... F01P 5/14 123/198 DB
7,403,847 B2 * 7/2008 Matsuda ..... F02P 5/1502 701/54
7,488,273 B2 * 2/2009 Carl ..... F02D 17/02 477/181
7,743,616 B2 * 6/2010 Renken ..... H02P 9/04 62/134
7,904,219 B1 * 3/2011 Lowrey ..... G07C 5/008 701/32.3
8,115,328 B2 * 2/2012 Fosbinder ..... B23K 9/1006 290/40 C
8,469,001 B2 * 6/2013 Yoshizaki ..... F02P 9/005 123/406.13
8,788,182 B2 * 7/2014 McDonald ..... F02D 13/06 701/110
9,086,020 B2 * 7/2015 Pirjaberi ..... F02D 17/02
9,200,575 B2 * 12/2015 Shost ..... F02D 17/02
9,708,950 B2 * 7/2017 Falkowski ..... F02D 41/005
9,938,922 B2 4/2018 Whitaker
9,979,337 B2 * 5/2018 Iles ..... H02P 9/48
10,118,684 B2 * 11/2018 Suzuki ..... F02D 29/06
2002/0115357 A1 * 8/2002 Hiki ..... B63H 21/213 440/1
2002/0117859 A1 * 8/2002 Kraus ..... F02D 29/06 290/41
2003/0075145 A1 * 4/2003 Sheidler ..... F02D 31/007 123/396
2003/0209909 A1 * 11/2003 Fukaya ..... F02B 63/04 290/40 A
2004/0002808 A1 * 1/2004 Hashimoto ..... F02D 11/107 701/107
2004/0201219 A1 * 10/2004 Kishibata ..... F02D 29/06 290/40 R
2005/0263513 A1 * 12/2005 Leisner ..... B23K 9/1006 219/133
2005/0280263 A1 * 12/2005 Albertson ..... B60W 10/06 290/40 B
2007/0084444 A1 * 4/2007 Bellistri ..... F02D 41/062 123/497
2009/0134845 A1 * 5/2009 Czajkowski ..... F02M 37/025 322/28
2010/0100299 A1 * 4/2010 Tripathi ..... F02P 5/1512 701/102
2010/0194118 A1 * 8/2010 Radtke ..... B23K 9/10 290/40 B
2011/0180043 A1 * 7/2011 Falkowski ..... F02D 37/02 123/478
2012/0175876 A1 * 7/2012 Pendray ..... H02J 3/46 290/41
2012/0292921 A1 * 11/2012 Fahringer ..... F02D 31/001 290/40 B
2013/0076034 A1 * 3/2013 Matsuda ..... B62M 23/02 290/7
2014/0045652 A1 * 2/2014 Carlson ..... B60W 30/19 477/109
2014/0163839 A1 * 6/2014 Staley ..... F02D 41/0087 701/103
2014/0172270 A1 * 6/2014 Lee ..... F02D 41/0087 701/102
2015/0280489 A1 * 10/2015 Curlett ..... H02J 7/1415 307/66
2015/0361912 A1 * 12/2015 Kopecek ..... F02D 17/02 123/406.2
2016/0061119 A1 * 3/2016 Vosz ..... F02D 41/0087 123/350
2016/0108834 A1 * 4/2016 McConville ..... F02D 13/06 123/90.15
2016/0115878 A1 * 4/2016 VanDerWege ..... F02D 41/0087 123/333
2016/0123193 A1 * 5/2016 Patterson ..... F01L 1/146 123/90.16
2017/0204788 A1 7/2017 Sakamoto et al.
2017/0204802 A1 * 7/2017 Sixel ..... F02D 17/023
2017/0260916 A1 * 9/2017 Kraemer ..... F02D 23/00
2017/0265381 A1 9/2017 Kuriyagawa et al.
2017/0265382 A1 9/2017 Kuriyagawa et al.
2017/0265395 A1 9/2017 Kuriyagawa et al.
2018/0046184 A1 * 2/2018 Subramanian ..... G05D 1/0061
2018/0223745 A1 * 8/2018 Atterberry ..... F02D 19/081
2018/0266637 A1 * 9/2018 Curlett ..... H01M 10/6554
2018/0298840 A1 * 10/2018 Hagiwara ..... F02B 69/04
2018/0334970 A1 * 11/2018 Kamo ..... F02D 17/02
2018/0362014 A1 * 12/2018 Durney ..... B60K 6/46

* cited by examiner

CYLINDER DEACTIVATION FOR A MULTIPLE CYLINDER ENGINE

CROSS-REFERENCE TO RELATED APPLICATIONS

This application claims the benefit of U.S. Provisional Application No. 62/569,292, filed Oct. 6, 2017, which is incorporated herein by reference in its entirety.

BACKGROUND

The present invention generally relates to internal combustion engines and outdoor power equipment and portable jobsite equipment powered by such engines. More specifically, the present invention relates to cylinder deactivation for one or more cylinders of an engine.

Outdoor power equipment includes lawn mowers, riding tractors, snow throwers, fertilizer spreaders, salt spreaders, chemical spreaders, pressure washers, tillers, log splitters, zero-turn radius mowers, walk-behind mowers, wide area walk-behind mowers, riding mowers, stand-on mowers, pavement surface preparation devices, industrial vehicles such as forklifts, utility vehicles, commercial turf equipment such as blowers, vacuums, debris loaders, over-seeders, power rakes, aerators, sod cutters, brush mowers, etc. Outdoor power equipment may, for example use an internal combustion engine to drive an implement, such as a rotary blade of a lawn mower, a pump of a pressure washer, the auger a snow thrower, the alternator of a generator, and/or a drivetrain of the outdoor power equipment. Portable jobsite equipment includes portable light towers, mobile industrial heaters, and portable light stands.

SUMMARY

One embodiment of the invention relates to portable jobsite equipment. The portable jobsite equipment includes a generator including an internal combustion engine and an alternator. The internal combustion engine includes a first cylinder including a first spark plug configured to create a first electrical spark, a second cylinder including a second spark plug configured to create a second electrical spark, an electronic control unit configured to activate and deactivate at least one of the first cylinder and the second cylinder, and a load source receiving supplied power from the generator. The electronic control unit activates one of the first cylinder and the second cylinder in response to a threshold increase of the load source.

Another embodiment of the invention relates to a generator. The generator includes an internal combustion engine and an alternator. The engine includes a first cylinder and a second cylinder, a current sensor configured to measure the current draw on the generator, and an electronic control unit configured to activate and deactivate at least one of the first cylinder and the second cylinder based on the measured current draw of the generator. When the current draw is under a current threshold, at least one of the first cylinder and the second cylinder are partially deactivated. When the current draw is above the current threshold, the first cylinder and the second cylinder are active.

Another embodiment of the invention relates to outdoor power equipment. The outdoor power equipment includes an internal combustion engine including a crankshaft having a power takeoff, an engine block including a first cylinder having a first intake passage opened and closed by a first intake valve and a second cylinder and a first exhaust passage opened and closed by a first exhaust valve, and a second cylinder having a second intake passage opened and closed by a second intake valve and a second exhaust passage opened and closed by a second exhaust valve, a first piston positioned within the first cylinder, a second piston positioned within the second cylinder, and an electronic control unit. The first piston is configured to reciprocate in the first cylinder to drive the crankshaft and the second piston is configured to reciprocate in the second cylinder to drive the crankshaft. The electronic control unit is configured to deactivate at least one of the first cylinder and the second cylinder by closing at least one of the first intake valve, the first exhaust valve, the second exhaust valve, and the second intake valve thereby preventing at least one of intake air from entering one of the first cylinder and the second cylinder and exhaust gases from exiting one of the first cylinder and the second cylinder.

BRIEF DESCRIPTION OF THE DRAWINGS

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to the figures generally, engines including systems and methods for cylinder deactivation are described herein. Engine cylinder deactivation may be employed in a multiple cylinder engine where one or more cylinders of an engine can be deactivated to provide for less than 100% power output from an engine and/or generator. For example, if a generator is used in connection with portable jobsite equipment, full power may not be necessary to power a typical load. Portable jobsite equipment, such as a light tower, may not require the full power from the generator to power the load associated with its lights and thus, one or more cylinders can be deactivated with the reduced number of active cylinders able to sufficiently power the load. After deactivation, if the full power is once again needed, one or more of the cylinders may be reactivated. One or more cylinders can be deactivated and/or reactivated using control of various components of the engine including, but not limited to, controlling spark plug firing events, controlling fuel delivery, opening and closing intake and exhaust valves, and closing a throttle plate, as described further herein. As used herein, the term "activate," "activation," "reactivate,"

or "reactivation" refers to instances where a cylinder is configured to combust an air/fuel mixture. As used herein, the terms "deactivate," "deactivation," "partial deactivation," or "partially deactivated" refer to instances where a cylinder is configured to skip at least one combustion event over the operation of the engine. In some cases, the term "deactivate" or "deactivation" refers to instances where one or more cylinders skip all combustion events over the course of operation of the engine.

Figure 1:
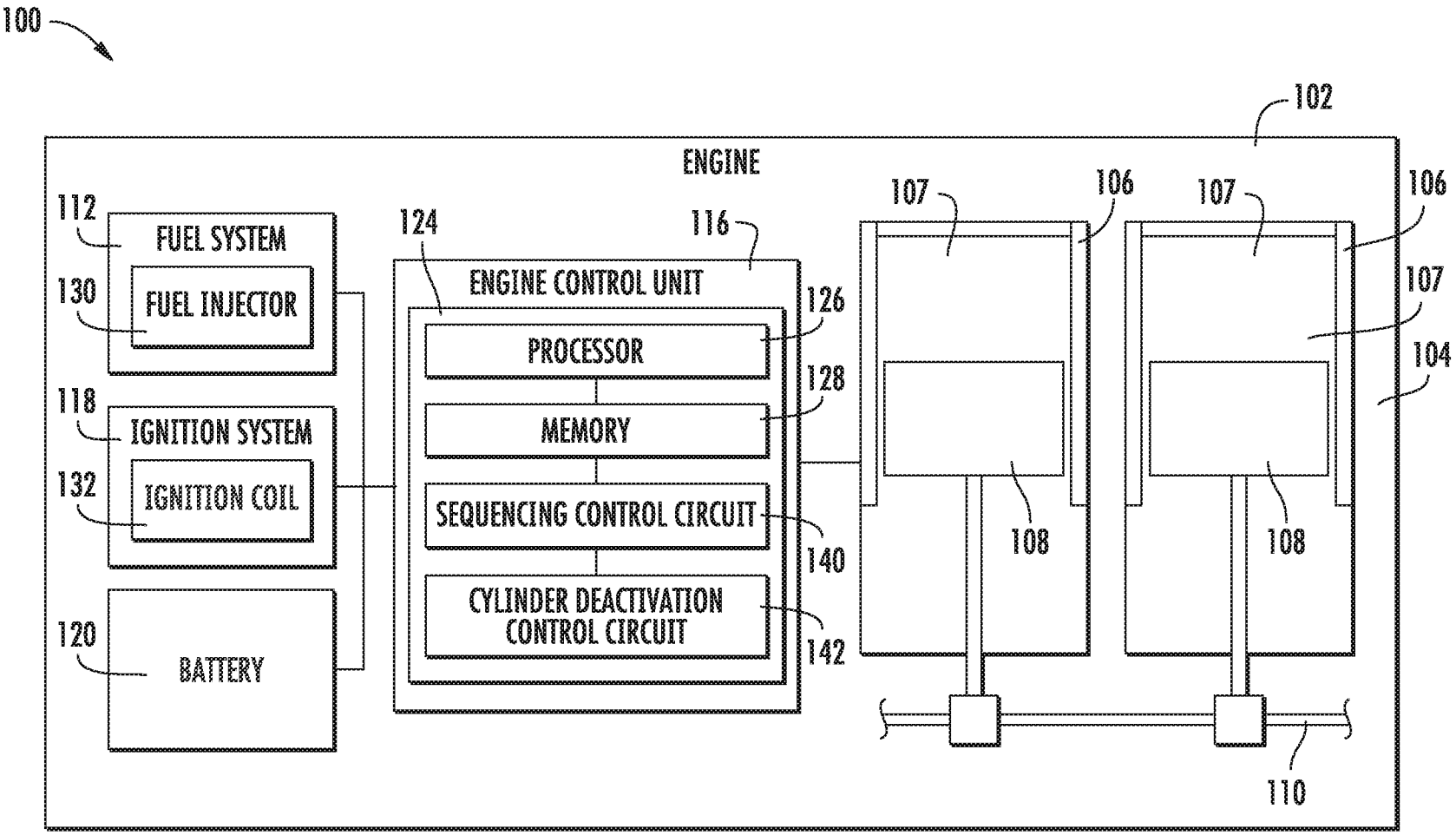
FIG. 1 is a schematic diagram of an engine cylinder control system, according to an exemplary embodiment.

Referring to FIG. 1, an engine cylinder control system is shown according to an exemplary embodiment. The engine cylinder control system 100 includes an internal combustion engine 102, including an engine block 104 having two or more cylinders 106, pistons 108, and a crankshaft 110. The pistons 108 reciprocate in the cylinders 106 to drive the crankshaft 110. In some embodiments as shown in FIG. 1, the engine 102 is a two-cylinder engine (e.g., arranged in a V-twin configuration). In other embodiments, the engine 102 includes more than two cylinders.

The engine 102 also includes an engine control unit (ECU) 116, a fuel system 112 (e.g., carburetor, electronic fuel injection (EFI) system, fuel delivery injector (FDI) unit, etc.), an ignition system 118, and a power supply 120 (e.g., a battery, a capacitor, etc.). The power supply 120 provides electrical power to the engine electrical systems (e.g., ECU 116, fuel system 112, ignition system 118). In some embodiments, the power supply 120 is a battery including a lithium-ion battery cell, or other appropriate battery cell, located within a housing.

The fuel system 112 provides an air-fuel mixture to the cylinders 106 for combustion processes. In one embodiment, the fuel system 112 includes an electronic fuel injection (EFI) system. In the illustrated embodiment, the fuel system 112 includes a fuel injector 130 for each cylinder 106 (e.g., positioned for port injection or direct injection). In other embodiments, the fuel system 112 includes a carburetor, fuel delivery injector, or other air/fuel mixing device. In the instance of a carbureted engine, the fuel system 112 includes a fuel delivery tube 180 (shown in FIG. 2). The fuel delivery tube 180 pulls fuel from a fuel reservoir 176 into a venturi 181 of the carburetor (shown in FIG. 2), as is discussed further herein.

The ignition system 118 includes an ignition coil 132. The ignition coil 132 is configured to up-convert a low voltage input provided by the battery 120 to a high voltage output to facilitate creating an electric spark from a spark plug 170 (shown in FIG. 3) to ignite the air-fuel mixture within the combustion chamber 107 of the engine 102. In other embodiments, the ignition system may be a magneto ignition system, a battery ignition system, a capacitor discharge ignition (CDI), a piezo ignition system, or other application ignition systems.

Referring to FIG. 1, the ECU 116 is configured to control operation of the engine 102, including the fuel system 112 and the ignition system 118. The fuel system 112 and ignition system 118 are in communication with the ECU 116 such that the fuel and ignition systems 112, 118 receive information and signals from the ECU 116. The ECU 116 includes a processing circuit 124 having a processor 126 and memory 128. The processor 126 may be implemented as a general-purpose processor, an application specific integrated circuit (ASIC), one or more field programmable gate arrays (FPGAs), a digital signal processor (DSP), a group of processing components, or other suitable electronic processing components. The memory 128 includes one or more memory devices (e.g., RAM, NVRAM, ROM, Flash Memory, hard disk storage, etc.) that store data and/or computer code for facilitating the various processes described herein. Moreover, the memory 128 may be or include tangible, non-transient volatile memory or non-volatile memory.

In some embodiments, the memory 128 may include various databases which retrievably store look-up tables, calculations, and other reference values and control schemes for operating conditions of the engine. These databases may be used in combination with the circuits described herein (e.g., sequencing control circuit 140, cylinder deactivation circuit 142) to provide necessary values for control operations of the engine 102 and various cylinder deactivation operations.

In various embodiments, when the fuel system 112 receives the appropriate signals from the ECU 116, the fuel system 112 controls the fuel injectors 130 and/or actuators positioned to interact with the fuel delivery tube 180 (e.g., actuators or valves 182, 184 configured to prevent fuel flow or allow fuel flow shown in FIG. 2) to time fuel delivery into the engine 102. In various embodiments, when the ignition system 118 receives the appropriate signals from the ECU 116, the ignition system 118 controls the timing of the spark plug firing events, including the skipping of firing events. Accordingly, the ECU 116 is configured to control the voltage input received by the ignition coil 132 from the battery 120, the voltage output from the ignition coil 132 to the spark plug 170, and/or the timing at which the spark is generated (e.g., via sequencing control circuit 140).

The ECU 116 includes a sequencing control circuit 140. The sequencing control circuit 140 is configured to control timing of spark plug firing events. In this regard, the sequencing control circuit 140 is communicably and operatively coupled to the ignition system 118 (e.g., ignition coil 132). The sequencing control circuit 140 provides spark plug firing sequencing information to the ECU 116 to control operation of the ignition coil 132. The sequencing control circuit 140 may initiate or interrupt spark plug firing events by controlling the operation of the ignition coil 132. The sequencing control circuit 140 can perform various firing sequences ranging from full power to one-third power (or in some embodiments less power). For example, the sequencing control circuit 140 is configured to allow full (100%) firing of the spark plug 170, where every firing event occurs as in normal operation of the engine 102. As another example, the sequencing control circuit 140 is also configured to operate at less than full firing power, where some spark plug firing events are skipped throughout the operation of the engine 102.

Figure 6:
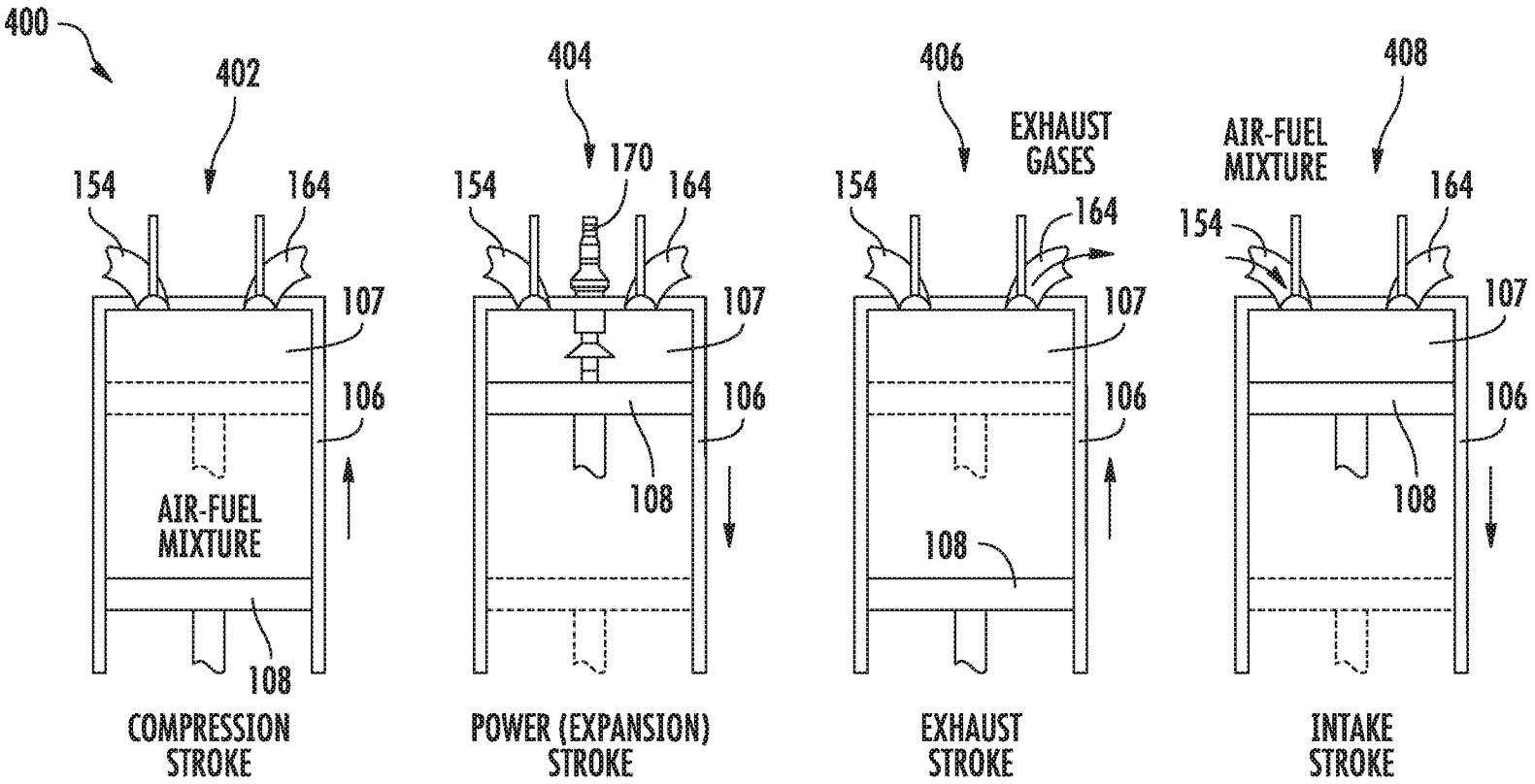
FIG. 6 is a schematic diagram of a four-stroke engine cycle.

As shown in FIG. 6, a four-stroke engine cycle 400 for the engine 102 includes a compression stroke 402, a power (expansion) stroke 404, an exhaust stroke 406, and an intake stroke 408. The engine cycle 400 shows the engine operation without the cylinder deactivation or sequencing controls described herein. During the intake stroke 408, the piston 108 begins at near top dead center (TDC) and ends at near bottom dead center (BDC) within the cylinder 106. During the intake stroke 408, an intake valve is opened while the piston 108 pulls an air/fuel mixture into the cylinder 106 through the cylinder intake passage 154. During the compression stroke 402, the piston 108 begins at BDC (or at the end of the intake stroke 408) and ends at TDC. During the compression stroke 402, the piston 108 compresses the air/fuel mixture in preparation for ignition. During the power (expansion) stroke 404, the piston 108 begins at TDC (or at the end of the compression stroke 402) and the compressed air/fuel mixture is ignited by a spark plug 170 forcefully returning the piston 108 to BDC. During the exhaust stroke 406, the piston 108 begins at near BDC and ends at near TDC within the cylinder 106. During the exhaust stroke 406, an exhaust valve is opened while the piston 108 moves toward TDC, expelling the spent air/fuel mixture through a cylinder exhaust passage 164. As described herein, in situations where the cylinder 106 is deactivated or partially deactivated, at least one combustion event that would typically occur during the power (expansion) stroke 404 is skipped. Deactivation or partial deactivation of the cylinder 106 is controlled by the cylinder deactivation control circuit 142 described further herein.

Referring back to FIG. 1, in some embodiments, the sequencing control circuit 140 is a controller separate from the ECU 116. In such embodiments, the sequencing control circuit 140 can be an after-market product packaged and sold separately from the engine 102 and/or ECU 116. As such, the sequencing control circuit 140 can include a housing and input/output connectors configured to interface with a connector on the ECU 116. A user of the engine 102 (e.g., or generator 200 shown in FIG. 4) can plug-in the sequencing control circuit 140 to the ECU 116 as a separate component to provide sequencing of the spark plug firing events. This allows the user to upgrade existing equipment by installing the after-market control circuit into the ECU 116.

Still referring to FIG. 1, the ECU 116 additionally includes a cylinder deactivation control circuit 142. The cylinder deactivation control circuit 142 is configured to control various components of the engine 102 to deactivate (or partially deactivate) and activate one or more cylinders 106 of the engine 102 in response to inputs received by the ECU 116. Inputs received by the ECU 116 may include, but are not limited to, engine speed values from the engine speed sensor 150, throttle position values (e.g., from throttle position sensor 161 shown in FIG. 2), and sensed current values (e.g., from current sensor 214 shown in FIG. 4) from a generator (e.g., a load from a generator). Based on the input values received by the ECU 116, the cylinder deactivation control circuit 142 operates various actuators or other components to effectuate cylinder deactivation and/or reactivation.

Figure 2:
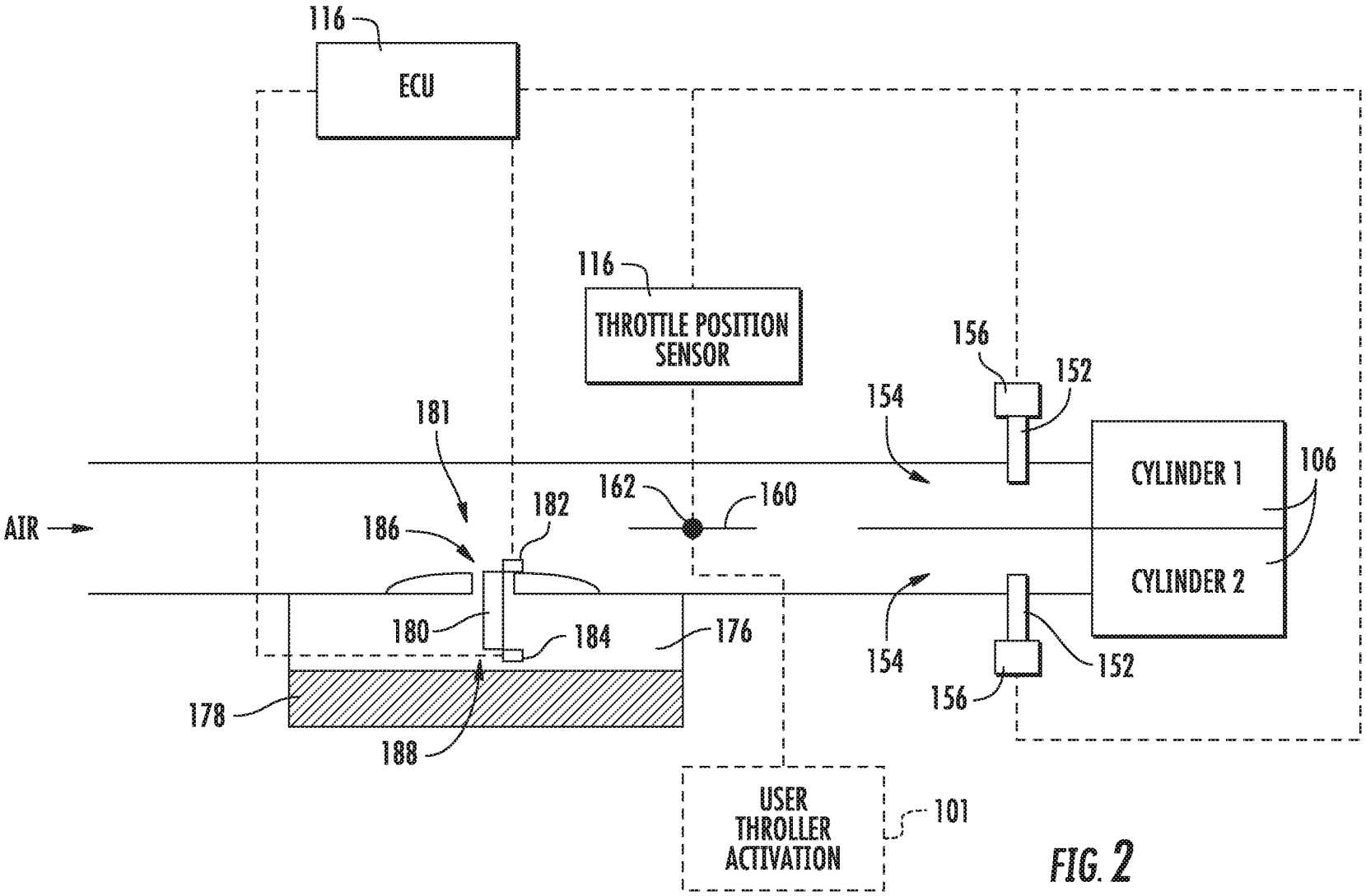
FIG. 2 is a schematic diagram of a fuel system of the engine of FIG. 1.

Referring to FIG. 2, in some embodiments, the cylinder deactivation control circuit 142 is configured to control the air/fuel flow into a cylinder 106. In one embodiment, the cylinder deactivation control circuit 142 opens and closes an intake plate or valve 152 in an intake passage 154 of one or more cylinders 106 using intake plate actuators 156. In this way, the air/fuel mixture provided to each cylinder 106 can be controlled. In response to an indication that a first cylinder 106 should be deactivated, the cylinder deactivation control circuit 142 controls the intake plate actuator 156 for that cylinder 106 to move the intake plate 152 to prevent air/fuel intake into that cylinder 106 by closing the intake passage 154. The intake plate 152 is included in addition to and separate from an intake valve 192 (shown in FIG. 3).

In another embodiment, the cylinder deactivation control circuit 142 is configured to control the position of the throttle plate 160 during an intake cycle of a specific cylinder 106 using a throttle plate actuator 162 (e.g., motor) coupled to the throttle plate 160 via a connection device, such as a throttle shaft. The throttle plate 160 controls the flow of an air/fuel mixture into the combustion chamber of the engine 102 and in doing so controls the air/fuel ratio of the engine 102. The throttle plate 160 is movable between a closed position and a wide-open position. In this embodiment, moving the throttle plate 160 to the closed position prevents fluid flow to both the first and second cylinders 106. In response to an indication that a first cylinder 106 should be deactivated, the cylinder deactivation control circuit 142 moves the throttle plate 160 to a fully closed position immediately prior to or simultaneous to the intake cycle of that cylinder 106. In this way, little to no air/fuel mixture is delivered to the cylinder 106 during the intake cycle and thus, the cylinder 106 has no mixture to compress, which effectively deactivates the cylinder 106. The opening and closing of the throttle plate 160 to deactivate a cylinder 106 requires a relatively fast actuation of the throttle plate 160. In this way, closing the throttle plate 160 acts to prevent intake during an intake cycle of a first cylinder 106, while the second cylinder is not in an intake cycle, and opening the throttle plate 160 subsequently allows intake during an intake cycle of a second cylinder 106. Accordingly, in this embodiment, the first cylinder 106 is deactivated, while the second cylinder 106 remains active.

In another embodiment, the throttle is controlled by a user using a user throttle activation 101 provided on the engine or on outdoor power equipment using the engine 102. The user selects (e.g., moves, presses, switches) the user throttle activation 101 to control engine speed via the throttle plate 160. In response to the user selecting the user throttle activation 101, the throttle plate 160 can be closed during an intake cycle of a cylinder 106, which as described above can deactivate that cylinder 106. Closing the throttle plate 160 during the intake cycle of the cylinder 106 prevents the delivery of an air/fuel mixture into the cylinder 106 such that the cylinder 106 has no mixture to compress, which effectively deactivates the cylinder 106.

In another embodiment, the cylinder deactivation control circuit 142 is configured to control the air intake flow into one or more cylinders 106. In this embodiment, the fuel system 112 includes an EFI system that controls the fuel injection into the engine 102. Air intake into the cylinder 106 is prevented by either closing the throttle plate 160 or by closing the intake plate 152 in the intake passage 154 of the cylinder 106. In this way, no air flows into the cylinder 106 and thus the compression cycle of the cylinder 106 is not wasted on just compressing air. In this embodiment, the EFI system is additionally controlled to provide no fuel to the cylinder 106 such that no fuel or air is provided to the cylinder. As noted above, the opening and closing of the throttle plate 160 to deactivate the cylinder 106 requires a relatively fast actuation of the throttle plate 160.

Still referring to FIG. 2, the cylinder deactivation control circuit 142 is also configured to control the fuel delivery into the engine 102. In one embodiment, the cylinder deactivation control circuit 142 controls actuators (e.g., nozzle actuator 182, jet actuator 184) positioned at or near a fuel delivery tube 180. The fuel delivery tube 180 extends from an inlet 188 within the fuel reservoir 176 to an outlet 186 at a venturi 181. In this embodiment, the cylinder deactivation control circuit 142 is configured to control a nozzle actuator 182 at the outlet 186 of the fuel delivery tube 180 to prevent fuel delivery at a specific time. In another embodiment, the cylinder deactivation control circuit 142 is configured to control a jet actuator 184 at the inlet 188 of the fuel delivery tube 180 to prevent the fuel delivery tube 180 from pulling in fuel 178 from the fuel reservoir 176 at a specific time.

In another embodiment, the cylinder deactivation control circuit 142 controls fuel injection on an engine 102 including an EFI system. The timing and duration of fuel injection from the fuel injectors 130 are controlled by the ECU 116. Each of the fuel injectors 130 may be controlled by an electronic solenoid (e.g., or any other type of actuator) which opens a valve at the discharge end of the fuel injectors 130. The ECU 116 signals the solenoids to open according to a timing and a duration scheme determined by the ECU 116. Accordingly, the ECU 116 can also interrupt signals to the fuel injectors 130 to skip fuel injection events, thus effectively deactivating that particular cylinder 106. The ECU 116 can also re-initiate signals to the fuel injectors 130 to provide for fuel injection to reactivate the cylinder 106 after a period of deactivation.

Figure 3:
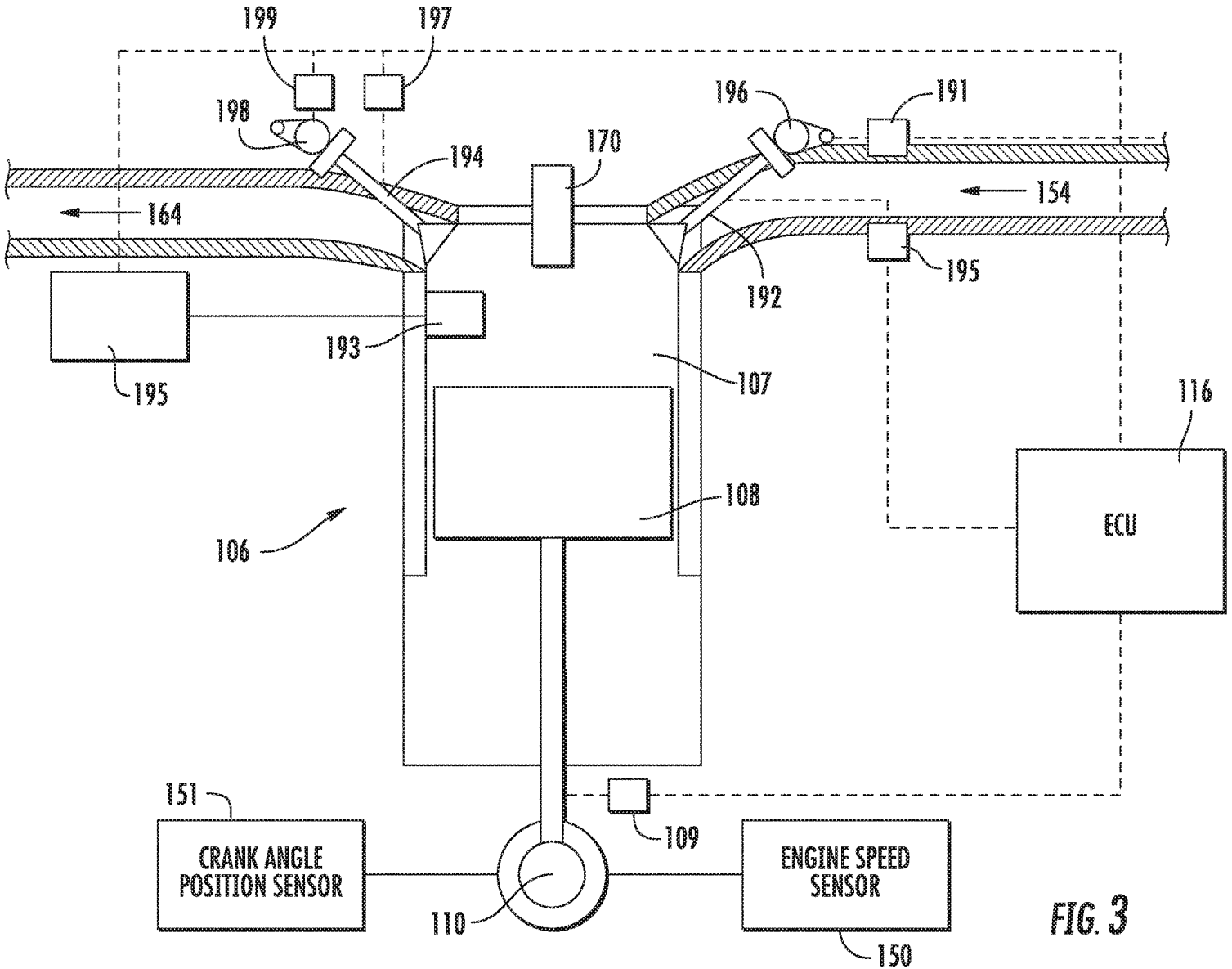
FIG. 3 is a schematic diagram of a cylinder of the engine of FIG. 1.

Referring to FIG. 3, a cylinder 106 of the engine 102 is shown. The engine 102 includes an air intake system with an intake passage 154 for each cylinder 106. The outlet of each intake passage 154 to the cylinder 106 is opened and closed by an intake valve 192. When the intake valve 192 is open, air or an air/fuel mixture from the intake passage 154 flows into the combustion chamber 107 of the cylinder 106 during an intake cycle of the cylinder 106 (e.g., downward movement of the piston 108). The engine 102 also includes an exhaust system configured to allow exhaust gases to exit the cylinder 106. The exhaust system includes an exhaust passage 164 open and closed by an exhaust valve 194, which controls the flow of exhaust gases from the cylinder 106 into the exhaust passage 164.

In some embodiments, an intake camshaft and an exhaust camshaft (not shown) are provided to control the opening and closing of the intake and exhaust valves 192, 194, respectively. An intake cam lobe 196 and an exhaust cam lobe 198 act to move the intake valve 192 and exhaust valve 194 in and out of respective valve seats to open and close the intake and exhaust passages 154, 164.

The cylinder deactivation control circuit 142 is configured to prevent intake suction of the cylinder 106. In one embodiment, the cylinder deactivation control circuit 142 is configured to prevent downward piston movement during the intake cycle of the cylinder 106. In this regard, a piston actuator 109 may be included to control the movement of the piston 108. The piston actuator 109 may be positioned on a connecting rod of the piston 108 and acts to decouple the connecting rod from the crankshaft 110 to allow the crankshaft 110 to rotate without moving the piston 108.

In another embodiment, the cylinder deactivation control circuit 142 is configured to relieve the vacuum in the cylinder 106 during the intake cycle. In one example, the exhaust valve 194 is opened at the same time as the intake valve 192 to eliminate the suction during an intake cycle. An exhaust valve actuator 197 moves the exhaust valve 194 to an open position (e.g., raises the exhaust valve 194 from the valve seat). In this way, at least a portion of the exhaust gases sitting within the exhaust passage 154 that were just released from the cylinder 106 during the exhaust cycle are pulled back into the cylinder 106 to neutralize (e.g., override) the vacuum that is created during the intake cycle of the cylinder 106. Therefore, air or air/fuel mixture will not be pulled into the cylinder 106 during intake and the cylinder 106 is effectively (i.e., at least partially) deactivated. The term "partially deactivated" refers to a condition where the cylinder 106 does not experience a combustion event during every power stroke, but at least one combustion event is deliberately skipped over the course of operation of the engine 102.

Still referring to FIG. 3, in another embodiment, the intake valve 192 is prevented from opening during the intake cycle. The intake valve 192 may be disabled (e.g., prevented from opening) during the intake cycle using an intake valve actuator 195 that moves the intake cam lobe 196 out of engagement with the intake valve 192. In another example, the exhaust valve 192 may be disabled (e.g., prevented from opening) prior to the intake cycle (or during the exhaust cycle) using the exhaust valve actuator 197 such that exhaust gases are not expelled from the cylinder 106, thereby reducing the vacuum effect in the cylinder during intake.

In another embodiment, the intake cam lobe 196 and/or the exhaust cam lobe 198 are controlled to open/close the intake and exhaust valves 192, 194. Intake and exhaust cam lobe actuators 191, 199 controlled by the ECU 116 and provided at or near the intake cam lobe 196 and/or exhaust cam lobe 198 may control the movement of the cam lobes 196, 198 and thus control the opening and closing of the intake and exhaust valves 192, 194.

In another embodiment, a pressurized air source 193 is provided that is powered by a pump 195 provided with the engine 102. In this embodiment, the pressurized air source 193 provides pressurized air into the cylinder 106 during the intake cycle such that air or air/fuel mixture is not pulled into the cylinder 106 due to the neutralization of the intake suction within the cylinder 106. The cylinder deactivation control circuit 142 communicates with the pump 195 to control the timing and duration of pressurized air introduced into the cylinder 106.

In some embodiments, the cylinder deactivation control circuit 142 provides for compression relief for a deactivated cylinder to eliminate or reduce compression or pumping losses in the cylinder 106. The cylinder deactivation control circuit 142 opens the intake or exhaust valve 192, 194 to allow intake air to exit the cylinder 106 during the compression cycle such that the air inside the cylinder 106 is not compressed and instead exits the cylinder 106. In this regard, fuel delivery is prevented, but intake air is allowed to enter the cylinder 106 during intake and freely exit the cylinder 106 during compression.

Various sensors are used to provide sensed input values to the ECU 116 (e.g., sequencing control circuit 140, cylinder deactivation circuit 142). Using the sensed input values, the ECU 116 controls the various components of the engine 102 to deactivate and reactivate one or more cylinders 106 based on the amount of power needed from the engine 102.

An engine speed sensor 150 (shown in FIG. 3) is coupled to the ECU 116 (and/or separate sequencing control circuit 140) to provide an engine speed input to the ECU 116. In some embodiments, the engine speed sensor 150 is positioned on the crankshaft 110 or flywheel to detect a speed of the crankshaft 110 and thus, engine speed. In other embodiments, the engine speed sensor 150 detects the engine speed using an ignition signal from the ignition system 118. For example, positive sparks or pulses from the ignition system 118 could be counted and used to determine the engine speed. In other embodiments, other appropriate engine speed sensors are utilized.

The sensed engine speed values can be used to detect changes in speed and/or load on the engine 102 and thus, whether one or more cylinders 106 should be deactivated or reactivated. The sensed engine speed values can be monitored between cycles of the engine 102. For example, it can be determined how much the engine is speeding up or slowing down relative to the combustion cycle the engine is currently experiencing. For instance, the amount by which the engine speeds up during an expansion cycle or slows down during a compression, intake, or exhaust cycle can be used to determine whether one or more cylinders should be deactivated or reactivated. In addition, the operation of the engine in a current intake and compression cycles can be compared to the operation of the engine in a previous intake and compression cycle to determine load changes. The operation of the engine can also be compared between current and previous expansion and exhaust cycles to determine load changes.

In addition, the current sensed engine speed values can be compared to previous sensed engine speed values to determine whether the engine is speeding up or slowing down. If the engine is speeding up, it is likely that the engine 102 is experiencing little to no load and thus, the ECU 116 may determine that a cylinder can be deactivated. If the engine is slowing down, it is likely that the load on the engine 102 is increasing and thus, the ECU 116 may determine that a cylinder should be reactivated.

In some embodiments, a throttle position sensor 161 (shown in FIG. 2) is coupled to the ECU 116 to provide throttle position input to the ECU 116. The throttle position sensor 161 is coupled to the throttle plate 160 or to the throttle plate actuator 162 to sense a position of the throttle plate 162 (e.g., ranging from wide-open to closed). A signal indicative of the position of the throttle plate 160 is produced and provided to the ECU 116. Because the throttle plate 160 position is changed based on a load experienced by the engine 102, the throttle plate 160 position can be indicative of a load experienced by the engine 102. This data can be used to determine whether one or more cylinders should be deactivated, partially deactivated, reactivated, or partially reactivated based on the load experienced by the engine 102.

In some embodiments, one or more crank angle position sensors 151 (shown in FIG. 3) are also provided at or near the crankshaft 110. The crank angle position sensor 151 produces a signal indicative of the position of the crankshaft 110 and provides the signal to the ECU 116. When used in combination with a camshaft position sensor, the position of the crankshaft 110 can provide data indicative of the cycle in which the cylinder 106 is operating. For example, if data is provided to the ECU 116 indicative of a 0 to 720 degree operating position, the ECU 116 can determine that the cylinder 106 is currently or will soon be experiencing an expansion cycle. This data can be used to control the sequencing of the spark plug firing events and fuel injection, along with other control aspects of the ECU 116. For example, where the throttle plate 160 position indicates an increased load, the ECU 116 may determine that a cylinder should be reactivated. Similarly, where the throttle plate 160 position indicates a reduced load, the ECU 116 may determine that a cylinder should be deactivated.

In some embodiments, a current sensor 214 (shown in FIG. 4) is provided for use with a generator 200. The current sensor 214 is configured to sense the current draw (e.g., load) on a generator 200, produce signals indicative of the current draw, and provide those signals to the ECU 116. The sensed current values can be used to determine whether one or more cylinders should be deactivated or reactivated. For example, where the current sensor 214 indicates a decreased current draw (e.g., decreased load), the ECU 116 may determine that a cylinder should be deactivated. If the current sensor 214 indicates an increase in current draw (e.g., increased load), the ECU 116 may determine that a deactivated cylinder should be reactivated.

Figure 4:
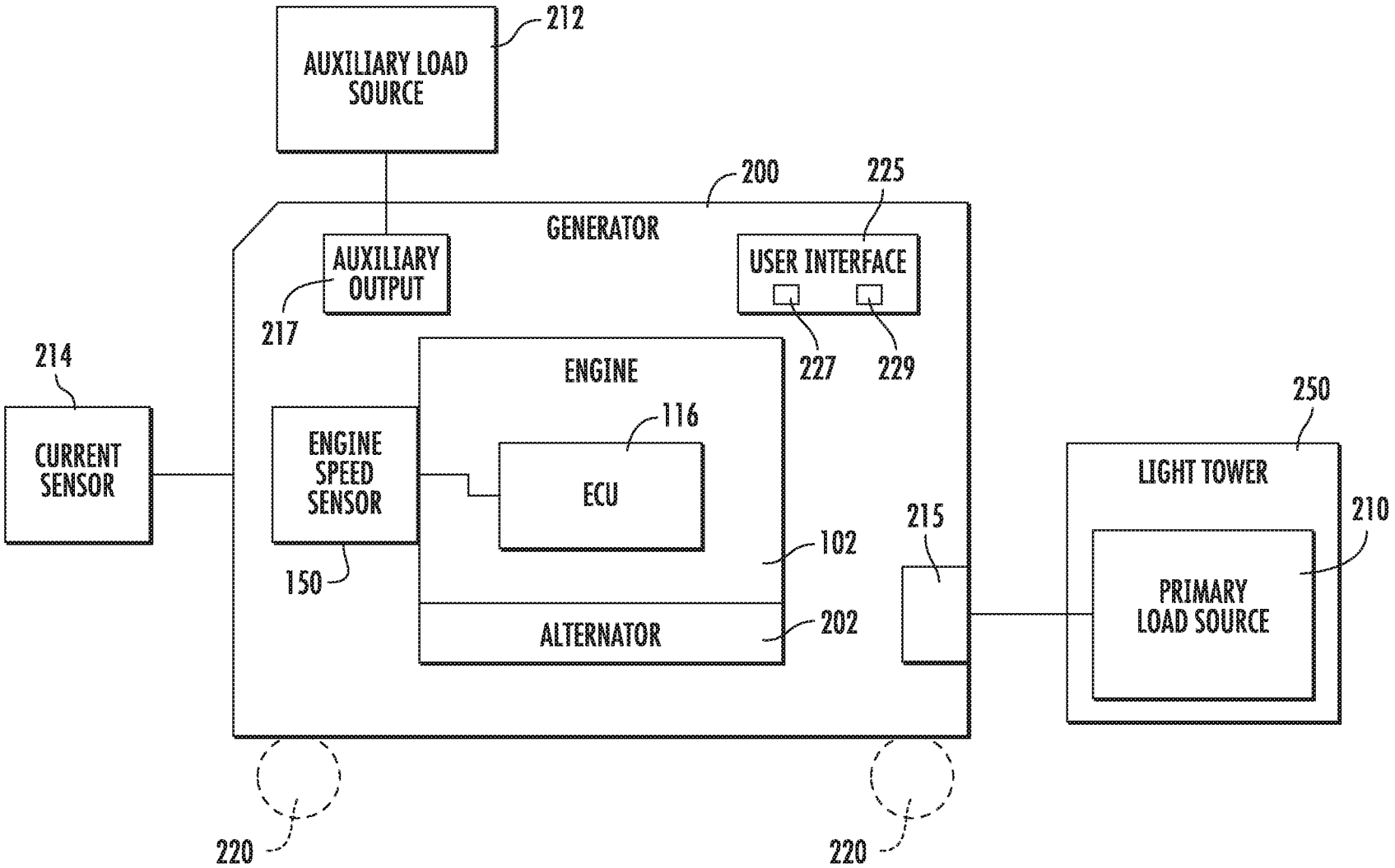
FIG. 4 is a schematic diagram of a generator using the engine cylinder control system of FIG. 1.

Referring to FIG. 4, a generator 200 is shown according to an exemplary embodiment. The generator 200 includes the engine 102 described above and an alternator 202. The alternator 202 produces electrical power from input mechanical power from the engine 102. The generator 200 additionally includes one or more outputs 215 (e.g., for supply of power to a primary load source 210) and auxiliary outputs 217 (e.g., for supply of power to an auxiliary load source 212) for supply of the generated electrical power to an electrical device of a user's choosing. In some embodiments, the generator 200 can also include one or more wheels 220 for portability.

The generator 200 can be used as a component of portable jobsite equipment, for example, a light tower 250 as the primary load source 210. Power generated from the generator 200 is provided to the light tower 250 to provide lighting at a jobsite. The light tower 250 may include various sources of lighting, including, but not limited to, light-emitting diodes (LEDs). Because certain types of lighting (e.g., LEDs) do not typically require large amounts of energy, it may be desirable to control the amount of power provided by the generator 200 so that power in excess of the amount needed to power the load is not generated. For example, if the generator 200 is using only 5 kilowatts of power (and typically runs at a full 10 kilowatts), it may be desirable to only generate half of the available power. By selectively deactivating one or more cylinders 106 of the engine 102 (e.g., intermittently, sequentially), the power generated by the generator 200 may be effectively reduced, thus wasting less energy than running the generator at full power.

As shown, the generator 200 may also include auxiliary outputs 217 that supply power to an auxiliary load source 212. In some instances, the auxiliary outputs 217 are not utilized and in other instances, a user may introduce an auxiliary load source 212 during the operation of the generator 200 such that in addition to the primary load source 210, the generator 200 experiences the auxiliary load source 212. For example, a user plugs a power tool into a 120 volt (V) electrical outlet on the generator 200 when the generator 200 is being used to power a light tower 250. The ECU 116 of the engine 102 can sense a load increase on the engine (e.g., using engine speed sensor 150) or a change in current draw on the generator 200 (e.g., using current sensor 214) and reactivate one or more cylinders in response to an increase in load or current draw.

The reactivation of cylinders may be proportional to the increased load and/or current draw and deactivation of cylinders may be proportional to a decreased load and/or current draw. For example, the ECU 116 receives signals from sensors indicative of an increase of power from 5 kilowatts to 7.5 kilowatts. In response to the detected change in load or current draw, the ECU 116 (e.g., via the cylinder deactivation control circuit 142) reactivates a cylinder, or using sequencing of spark plug firing events increases the power from 50% of full power to 75% of full power.

Still referring to FIG. 4, the generator additionally includes a user interface 225. The user interface 225 can include a display (e.g., indication lights 227) and a user actuation control 229. The indication lights 227 can indicate when or if a particular cylinder is ready for use. For example, if a cylinder 106 has been idle for a period of time it may become cold. Thus, the ECU 116 may communicate to the indication lights 227 that the cylinder is not yet ready for activation or can communicate that the cylinder is currently ready to activate. The user actuation control 229 can include a push button or other actuator to turn a cylinder deactivation mode on or off. The user actuation control 229 is configured to communicate with the ECU 116 whether a cylinder deactivation mode should be enabled. When the cylinder deactivation mode is on, the ECU 116 performs as described herein, but when the cylinder deactivation mode is off, the ECU 116 can return to normal operation of the generator 200 and/or engine 102, where no cylinder deactivation occurs. In some embodiments, the engine 102 is configured to start with only one cylinder activated and/or at less than full power. In other embodiments, the engine 102 is configured to start at full power. In other embodiments, the engine 102 can start at either full power or at less than full power. The use of cylinder deactivation while running the generator 200 and/or engine 102 may result in reduced fuel consumption, extended runtime, and quieter operation.

Figure 5:
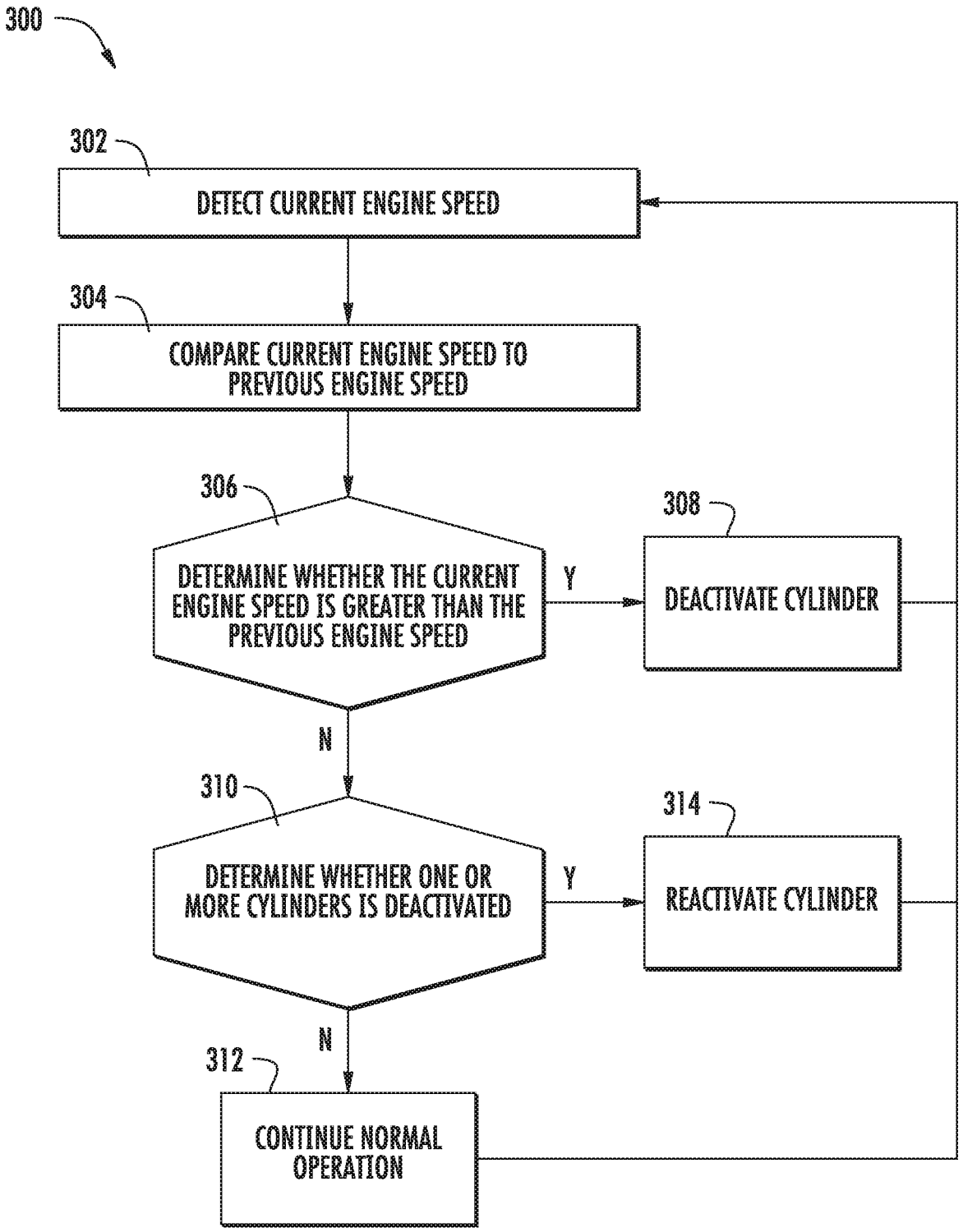
FIG. 5 is a method of deactivating and reactivating a cylinder of an engine, according to an exemplary embodiment.

Referring to FIG. 5, a method for controlling activation of a cylinder is shown, according to an exemplary embodiment. The method 300 is performed by the ECU 116 shown in FIG. 1. In some embodiments, the method 300 is performed by a separate sequencing control circuit 140 shown in FIG. 1. A current engine speed is detected at 302. The current engine speed is detected by the engine speed sensor 150. As described above, the engine speed sensor 150 is coupled to the ECU 116 to provide an engine speed input to the ECU 116.

The current engine speed is compared to a previous engine speed at 304. The previous engine speed may be retrieved from an engine speed/load database included in the memory 128 of the ECU 116. It is determined whether the current engine speed is greater than the previous engine speed at 306. If the current engine speed is greater than the previous engine speed, the ECU 116 deactivates one or more cylinders and/or performs appropriate firing sequencing events to reduce the power generated by the engine at 308. If the current engine speed is less than the previous engine speed, it is determined whether there are deactivated cylinders or if the system is running at less than full power at 310. If the system is running at full power, normal operation continues at 312. If the system is running at less than full power, one or more cylinders are reactivated and/or appropriate firing sequencing events are performed to increase the power generated by the engine at 314. A similar cylinder deactivation and reactivation method can be performed using sensed current draw on a generator and sensed load values on an engine. In addition, instead of using a current instantaneous engine speed value, an average of engine speed values may be used and compared to previous average engine speed values to make a determination of activating or deactivating cylinders.

The sequencing control circuit 140 can control the ignition system 118 to skip one or more spark plug firing events during the operation of the cylinders 106. First, the sequencing control circuit 140 is configured to allow full (100%) firing of the spark plug 170, where every normally occurring firing event occurs as in normal operation of the engine 102. Second, the sequencing control circuit 140 is configured to operate at less than full firing power, where some spark plug firing events are skipped throughout the operation of the engine 102. In one embodiment, the sequencing control circuit 140 is configured to provide approximately 80% firing power, where one out of every five firing events is skipped. Using this embodiment with a two-cylinder engine, every other skipped firing event is skipped in each of the two cylinders such that equal firing events are skipped between the two cylinders.

In another embodiment, the sequencing control circuit 140 is configured to provide approximately three-quarter (75%) firing power, where one out of every four firing events is skipped. In a two-cylinder engine, every skipped firing event is skipped in only one of the two cylinders such that the other cylinder operates at full firing power. In another embodiment, the sequencing control circuit 140 is configured to provide approximately two-thirds (67%) firing power, where one out of every three firing events are skipped. Equal firing events are skipped between the two cylinders. In another embodiment, the sequencing control circuit 140 is configured to provide approximately three-fifths (60%) firing power, where two out of every five firing events are skipped. Skipped firing events occur twice in each cylinder at a time before the skipped firing events are switched to the other cylinder. In another embodiment, the sequencing control circuit 140 is configured to provide approximately four-sevenths (57%) firing power, where three out every seven firing events are skipped.

In another embodiment, the sequencing control circuit 140 is configured to provide approximately half (50%) of the full firing power. In this embodiment, one out of every two firing events are skipped equally between the two cylinders. In another embodiment, the sequencing control circuit 140 is configured to provide approximately one-third (33%) of full firing power. In this embodiment, two out of every three firing events are skipped equally amongst the cylinders. According to various embodiments, the sequencing control circuit 140 is configured to control cylinder activation percentages in response to any load condition experienced by an engine 102 or generator 200.

The skipped cylinder events can coincide with positions of the crankshaft 110. As the engine 102 moves through the various cycles of the combustion process, the crankshaft 110 is in various positions relative to each cylinder throughout the process. For example, the crankshaft 110 is at 0/720 degrees rotation from an initial position for a first cylinder (e.g., when a spark plug in the first cylinder is normally firing) and at 270 degrees rotation from an initial position for a second cylinder (e.g., when the second cylinder is in the exhaust cycle). The skipped cylinder events occur at times when the cylinders 106 normally receive firing events. In some embodiments, the system also times skipped firing events to occur when waste sparks (e.g., sparks generated during the exhaust stroke) are normally timed.

The embodiments described herein have been described with reference to drawings. The drawings illustrate certain details of specific embodiments that implement the systems, methods and programs described herein. However, describing the embodiments with drawings should not be construed as imposing on the disclosure any limitations that may be present in the drawings.

It should be understood that no claim element herein is to be construed under the provisions of 35 U.S.C. § 112(f), unless the element is expressly recited using the phrase "means for."

As used herein, the term "circuit" may include hardware structured to execute the functions described herein. In some embodiments, each respective "circuit" may include machine-readable media for configuring the hardware to execute the functions described herein. The circuit may be embodied as one or more circuitry components including, but not limited to, processing circuitry, network interfaces, peripheral devices, input devices, output devices, sensors, etc. In some embodiments, a circuit may take the form of one or more analog circuits, electronic circuits (e.g., integrated circuits (IC), discrete circuits, system on a chip (SOCs) circuits, etc.), telecommunication circuits, hybrid circuits, and any other type of "circuit." In this regard, the "circuit" may include any type of component for accomplishing or facilitating achievement of the operations described herein. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on).

The "circuit" may also include one or more processors communicably coupled to one or more memory or memory devices. In this regard, the one or more processors may execute instructions stored in the memory or may execute instructions otherwise accessible to the one or more processors. In some embodiments, the one or more processors may be embodied in various ways. The one or more processors may be constructed in a manner sufficient to perform at least the operations described herein. In some embodiments, the one or more processors may be shared by multiple circuits (e.g., circuit A and circuit B may comprise or otherwise share the same processor which, in some example embodiments, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. Each processor may be implemented as one or more general-purpose processors, application specific integrated circuits (ASICs), field programmable gate arrays (FPGAs), digital signal processors (DSPs), or other suitable electronic data processing components structured to execute instructions provided by memory. The one or more processors may take the form of a single core processor, multi-core processor (e.g., a dual core processor, triple core processor, quad core processor, etc.), microprocessor, etc. In some embodiments, the one or more processors may be external to the apparatus, for example the one or more processors may be a remote processor (e.g., a cloud based processor). Alternatively or additionally, the one or more processors may be internal and/or local to the apparatus. In this regard, a given circuit or components thereof may be disposed locally (e.g., as part of a local server, a local computing system, etc.) or remotely (e.g., as part of a remote server such as a cloud based server). To that end, a "circuit" as described herein may include components that are distributed across one or more locations.

An exemplary system for implementing the overall system or portions of the embodiments might include a general purpose computing computers in the form of computers, including a processing unit, a system memory, and a system bus that couples various system components including the system memory to the processing unit. Each memory device may include non-transient volatile storage media, non-volatile storage media, non-transitory storage media (e.g., one or more volatile and/or non-volatile memories), etc. In some embodiments, the non-volatile media may take the form of ROM, flash memory (e.g., flash memory such as NAND, 3D NAND, NOR, 3D NOR, etc.), EEPROM, MRAM, magnetic storage, hard discs, optical discs, etc. In other embodiments, the volatile storage media may take the form of RAM, TRAM, ZRAM, etc. Combinations of the above are also included within the scope of machine-readable media. In this regard, machine-executable instructions comprise, for example, instructions and data which cause a general purpose computer, special purpose computer, or special purpose processing machines to perform a certain function or group of functions. Each respective memory device may be operable to maintain or otherwise store information relating to the operations performed by one or more associated circuits, including processor instructions and related data (e.g., database components, object code components, script components, etc.), in accordance with the example embodiments described herein.

What is claimed is:

1. Portable jobsite equipment comprising:

a generator comprising a two-cylinder internal combustion engine and an alternator, wherein the two-cylinder internal combustion engine comprises:

a first cylinder including a first spark plug configured to create a first electrical spark;

a second cylinder including a second spark plug configured to create a second electrical spark, the first cylinder and second cylinder being arranged in a v-twin configuration; and an electronic control unit configured to activate and deactivate at least one of the first cylinder or the second cylinder by adjusting an activation sequence of the first spark plug and the second spark plug, wherein activating the first cylinder or second cylinder comprises firing the first spark plug or the second spark plug and wherein deactivating the first cylinder or second cylinder comprises skipping one or more spark plug firing events of the first spark plug or the second spark plug; and a load source receiving supplied power from the generator;

wherein the electronic control unit activates one of the first cylinder or the second cylinder by respectively increasing a frequency of activation of the first spark plug and a frequency of activation of the second spark plug in response to a threshold increase of the load source, wherein the threshold increase of the load source is identified by the electronic control unit by detecting a decrease in engine speed; and wherein each of the first spark plug and the second spark plug is fired at least half as often as the other spark plug.

2. The portable jobsite equipment of claim 1, wherein the electronic control unit comprises a sequencing control circuit configured to control timing of one or more spark plug firing events to adjust the activation sequence of the first spark plug and the second spark plug.

3. The portable jobsite equipment of claim 2, further comprising an auxiliary load source, wherein the electronic control unit activates one of the first cylinder and the second cylinder by increasing a frequency of activation of the first spark plug and the second spark plug in response to detection of the auxiliary load source.

4. The portable jobsite equipment of claim 1, wherein the electronic control unit comprises a sequencing control circuit configured to control timing of one or more spark plug firing events;

wherein in response to detection of removal of an auxiliary load, the sequencing control circuit increases an amount of one or more skipped spark plug firing events.

5. The portable jobsite equipment of claim 1, wherein the portable jobsite equipment comprises a light tower.

6. Outdoor power equipment comprising:

an internal combustion engine comprising:

a crankshaft having a power takeoff;

a two-cylinder engine block including a first cylinder and a second cylinder arranged in a v-twin configuration, wherein the first cylinder comprises a first intake passage opened and closed by a first intake valve, a first exhaust passage opened and closed by a first exhaust valve, and wherein the second cylinder comprises a second intake passage opened and closed by a second intake valve and a second exhaust passage opened and closed by a second exhaust valve;

a first piston positioned within the first cylinder, wherein the first piston is configured to reciprocate in the first cylinder to drive the crankshaft;

a second piston positioned within the second cylinder, wherein the second piston is configured to reciprocate in the second cylinder to drive the crankshaft;

and an electronic control unit configured to activate and deactivate at least one of the first cylinder or the second cylinder, wherein activating a cylinder comprises opening the first intake valve or the second intake valve and wherein deactivating a cylinder comprises closing at least one of the first intake valve, the first exhaust valve, the second exhaust valve, or the second intake valve thereby preventing at least one of intake air from entering one of the first cylinder or the second cylinder and exhaust gases from exiting one of the first cylinder or the second cylinder, wherein the electronic control unit deactivates at least one of the first cylinder or the second cylinder, wherein the electronic control unit deactivates at least one of the first cylinder or the second cylinder in response to determining that an amount that the internal combustion engine slows down during a compression cycle has decreased relative to previous compression cycles;

and wherein each of the first and second intake valves is opened at least half as often as the other intake valve.

7. The outdoor power equipment of claim 6, wherein the electronic control unit activates one of the first cylinder and the second cylinder based on detection of a predetermined increase of a load on the equipment, wherein the detection of the predetermined increase of the load on the equipment is detected by the electronic control unit determining that an amount that the internal combustion engine slows down during a compression cycle has increased relative to previous compression cycles.

8. The outdoor power equipment of claim 6, wherein the electronic control unit comprises a sequencing control circuit configured to control timing of one or more spark plug firing events.

9. The outdoor power equipment of claim 8, wherein deactivating a cylinder comprises skipping one or more spark plug firing events.

10. A generator comprising a two-cylinder internal combustion engine and an alternator, wherein the two-cylinder internal combustion engine comprises:

a first cylinder and a second cylinder arranged in a v-twin configuration;

an engine speed sensor configured to detect a current engine speed of the internal combustion engine; and an electronic control unit configured to receive the current engine speed from the engine speed sensor, compare the current engine speed to a stored engine speed, and activate and deactivate at least one of the first cylinder and the second cylinder by adjusting an activation sequence of the first cylinder and the second cylinder based on a difference between the detected current engine speed of the internal combustion engine and the stored engine speed, wherein adjusting the activation sequence of the first cylinder and second cylinder includes adjusting a firing order of a first spark plug within the first cylinder and a second spark plug within the second cylinder, wherein activating one of the first cylinder or the second cylinder comprises firing the first spark plug or the second spark plug associated with the first cylinder or the second cylinder and wherein deactivating the first cylinder or the second cylinder comprises skipping one or more spark plug firing events or the first spark plug or the second spark plug;

wherein when the current engine speed is higher than the stored engine speed, at least one of the first cylinder or the second cylinder is partially deactivated by the electronic control unit by reducing a firing frequency of at least one of the first spark plug or the second spark plug;

wherein when the current engine speed is lower than the stored engine speed, the firing frequency of at least one of the first spark plug or the second spark plug is increased by the electronic control unit, and wherein each of the first spark plug and the second spark plug is fired at least half as often as the other spark plug.

11. The generator of claim 10, wherein the stored engine speed is based upon a value previously detected by the engine speed sensor.

12. The generator of claim 10, wherein the electronic control unit controls a firing control percentage to approximately match a load percentage on the generator by skipping one or more firing events in at least one of the first cylinder and the second cylinder.

13. The generator of claim 10, wherein when the electronic control unit determines that the load on the generator is approximately 50% of a power rating of the generator, the electronic control unit initiates an approximate 50% sequencing firing control; and wherein the approximate 50% sequencing firing control includes skipping approximately half of the normally scheduled spark plug firing events in each of the first cylinder and the second cylinder.

14. The generator of claim 10, wherein when the electronic control unit determines that the load on the generator is approximately 75% of a power rating of the generator, the electronic control unit initiates an approximate 75% sequencing firing control; and wherein the approximate 75% sequencing firing control includes skipping approximately 50% of the normally scheduled spark plug firing events in one of the first cylinder or the second cylinder and operating the other of the first and second cylinders at full firing frequency.

15. The portable jobsite equipment of claim 1, wherein the decrease in engine speed is detected by an engine speed sensor in communication with the electronic control unit.

16. The portable jobsite equipment of claim 15, wherein the electronic control unit compares a current engine speed from the engine speed sensor to a stored engine speed to determine the decrease in engine speed.

17. The portable jobsite equipment of claim 16, wherein the stored engine speed is a value previously measured by the engine speed sensor.

18. The portable jobsite equipment of claim 1, wherein when the electronic control unit detects an increase in engine speed, the electronic control unit adjusts the activation sequence of the first spark plug and the second spark plug such that each cylinder in the internal combustion engine is selectively deactivated to reduce a power output of the generator.

19. The portable jobsite equipment of claim 18, wherein when the electronic control unit determines that the load on the generator is approximately 60% of a power rating of the generator, the electronic control unit initiates an approximate 60% sequencing firing control;

wherein the electronic control unit is configured to control the first spark plug and the second spark plug to distribute skipped firing events equally between the first cylinder and the second cylinder; and wherein the approximate 60% sequencing firing control includes skipping approximately two out of every five of the normally scheduled spark plug firing events in each of the first cylinder and the second cylinder, wherein two skipped firing events occur sequentially in each cylinder before the skipped firing events are switched to the other cylinder.

* * * * *